US007926807B2

(12) United States Patent
Dahlgren

(10) Patent No.: US 7,926,807 B2
(45) Date of Patent: Apr. 19, 2011

(54) DOUBLE SHEET FEED DETECTOR AND METHOD

(75) Inventor: Max W. Dahlgren, Arlington, TX (US)

(73) Assignee: Epic Products International Corp., Arlington, TX (US)

( * ) Notice: Subject to any disclaimer, the term of this patent is extended or adjusted under 35 U.S.C. 154(b) by 26 days.

(21) Appl. No.: 12/206,321

(22) Filed: Sep. 8, 2008

(65) Prior Publication Data

US 2009/0102114 A1 Apr. 23, 2009

Related U.S. Application Data

(60) Provisional application No. 60/935,946, filed on Sep. 7, 2007.

(51) Int. Cl.
*B65H 7/12* (2006.01)

(52) U.S. Cl. ..... 271/262

(58) Field of Classification Search ..... 271/262, 271/263, 265.04
See application file for complete search history.

(56) References Cited

U.S. PATENT DOCUMENTS

| | | | | |
|---|---|---|---|---|
| 4,420,747 | A | 12/1983 | Kistner | |
| 5,988,634 | A * | 11/1999 | Elrick et al. | 271/265.04 |
| 6,634,598 | B2 | 10/2003 | Susko | |
| 6,672,587 | B1 * | 1/2004 | Mohringer et al. | 271/259 |
| 6,955,348 | B2 | 10/2005 | Koga | |
| 7,125,014 | B2 | 10/2006 | Dolz et al. | |
| 7,207,558 | B2 | 4/2007 | Edinger | |

* cited by examiner

*Primary Examiner* — David H Bollinger
(74) *Attorney, Agent, or Firm* — Buchanan Ingersoll & Rooney PC

(57) ABSTRACT

A feeder head includes suction belts to sequentially feed top sheets from a stack of sheets (e.g., paper). Before the belts receive suction and drive power, a suction cup raises the top sheet at a location between the belts to produce a corrugated shape in the top sheet which induce separation of a second sheet that might be adhered to the top sheet. A double sheet detector includes a pair of rollers forming a nip through which a fed sheet passes, causing the rollers to separate. The amount of separation is transmitted to a transducer which generates a signal proportional to the sheet thickness. Signals from the transducer are frequently sensed and averaged, so that signal variations resulting from irregularities in the shape of the rollers are canceled out.

7 Claims, 7 Drawing Sheets

DOUBLE SHEET FEED DETECTOR AND METHOD

This application claims the benefit of the Sep. 7, 2007 filing date of provisional application No. 60/935,946.

BACKGROUND

The present invention relates to sheet feeding and, in particular, to the feeding of sheets, such as paper sheets, one-at-a-time from a stack and detecting double sheets.

It is known to feed sheets sequentially, i.e., one-at-a-time from a vertical stack, e.g., in sheet-printing and sheet-coating machines. For example, U.S. Pat. Nos. 7,125,014 and 7,207,558 disclose a sheet feeding apparatus employing suction belts which grip the upper surface of a top sheet in the stack and advance the sheet. The disclosures of those patents are incorporated by reference herein.

It is, of course, desirable to prevent the feeding of double sheets, defined herein as arising when a second sheet adheres itself to the underside of the sheet above it in the stack, e.g., due to static friction. Such double sheet feeding is undesirable, especially in the case where paper sheets are fed to a sheet-coating apparatuses in which the coatings are cured by passing the coated sheets beneath a heater which emits intense heat. In the case of double sheets being fed, the extra bottom sheet can become dislodged from the top sheet and possibly immobilized beneath the heater, whereupon overheating of the immobilized sheet can produce a fire.

Efforts to sense the feeding of double sheets are known, such as disclosed in U.S. Pat. No. 4,420,747 in which sheets are passed successively through the nip of a roller pair, a lower one of the rollers being driven about a fixed axis, and a top one of the rollers being freewheeling and vertically movable. The passing of a sheet through the nip causes the top roller to be displaced upwardly. That roller displacement is sensed by a transmitter which sends a signal to electric evaluator circuits. When double sheets pass through the nip, the greater thickness of the double sheets produces an increase in the roller displacement, which is sensed by the evaluator circuits, and an appropriate warning signal is produced. The disclosure of this patent is incorporated by reference herein.

Despite the precaution heretofore taken in the art to prevent the feeding of double sheets, room for improvement remains. For example, in the case of the roller pair disclosed in aforementioned U.S. Pat. No. 4,420,747, it will be appreciated that expensive rollers of high-precision manufacture and positioning are required in order to be able to reliably detect the minute difference in sheet thickness between a single sheet and double sheets, especially when very thin paper sheets are being fed. The reason is that if rollers of imprecise positioning or shape, e.g., of eccentric or out-of-round shape, are used, displacements of the freewheeling roller can occur just because of such imprecise positioning or shape. Since the difference in roller displacement between the feeding of single sheets versus double sheets is minute, the creation of such false displacements can produce unreliable results.

It would be desirable to provide a sheet feeding system which minimizes the chances for double sheets to be fed from a stack, and/or maximizes the chances for the feeding of double sheets to be detected along a feed path.

SUMMARY

In the disclosed preferred embodiment a feeder head includes a suction cup which can be lowered, together with straddling suction belts, against the top sheet of the stack. With the belts stationary and receiving no suction, suction is applied to the cup so the top sheet adheres to the cup at a location between the suction belts. The cup is then raised relative to the belts, causing the top sheet to assume a wavy or corrugated shape. As a result, if another sheet is adhered to the underside of the top sheet, it will tend to become dislodged and fall back onto the stack. Then, suction is applied to the belts and removed from the cup. The top sheet is now adhered only to the belts which are driven to feed the top sheet.

In another aspect, a sheet being fed is advanced across a brush. Bristles of the brush engage the underside of the sheet being fed. In the case of double sheets being fed, i.e., when a second sheet is adhered to the underside of the sheet being fed, movement of the second sheet will be retarded by contact with the bristles, thereby tending to dislodge the second sheet from the upper sheet.

In yet another aspect, a sheet being fed is advanced through a nip formed between a pair of rollers. A bottom one of the rollers is driven, while the top roller is free-wheeling and mounted on a bracket arranged to pivot about a substantially horizontal axis. When a sheet passes through the nip, the thickness of the sheet causes the top roller to move upwardly, away from the bottom roller. That causes the bracket to pivot and engage a lever which transmits the movement to the reciprocable plunger of a transducer, causing the transducer to send a signal to an evaluator circuit. The signal strength is proportional to the extent of movement of the lever. Thus, when double sheets are fed, the added thickness of the extra sheet will result in a stronger signal being generated which can be evaluated to identify the presence of a double-sheet condition. The transmitter signals are detected very frequently, e.g., once per millisecond, and the detected signals are averaged so that signal variations produced by irregularities in the shape or orientation of the rollers, etc., will cancel-out whereby the evaluator circuit will be able to recognize a signal change resulting from the presence of a double sheet condition.

DETAILED DESCRIPTION

Figure 1A:
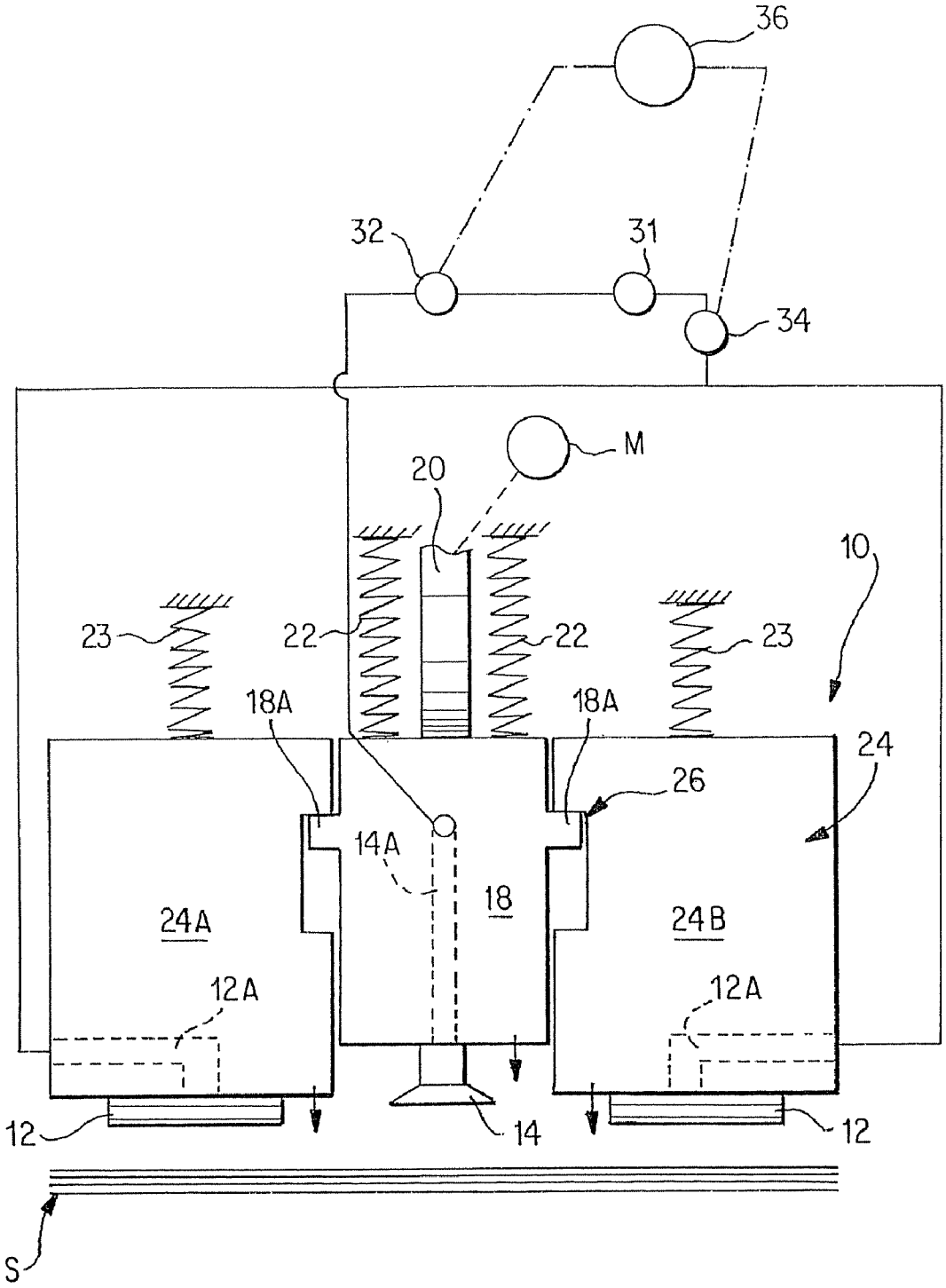
FIGS. 1A-1D are schematic front views of a sheet feeder showing respective stages of operation.

Depicted schematically in FIGS. 1A-1D is a feeder head 10 which functions to sequentially pick-up topmost sheets from a stack and advance them. For example, the sheets could be advanced to a coating apparatus of the type which cures indicia on the sheets by passing the sheets beneath a heating device.

The feeder head 10 includes relatively movable suction mechanisms, e.g., a pair of side suction devices, preferably in the form of two perforated horizontal suction belts 12 which straddle an intermediate suction device in the form of a row of suction cups 14 (only one suction cup shown in FIGS. 1A-1D). Negative pressure (suction) can be selectively applied to the suction belts 12 via conduits 12A, and selectively applied to the suction cups 14 via conduit 14A.

Each suction belt is mounted endlessly around a pair of rollers 19, 21, one of which 19 is driven, so that the horizontal lower flights of the belts can horizontally displace a sheet that is adhered thereto by suction.

Figure 4:
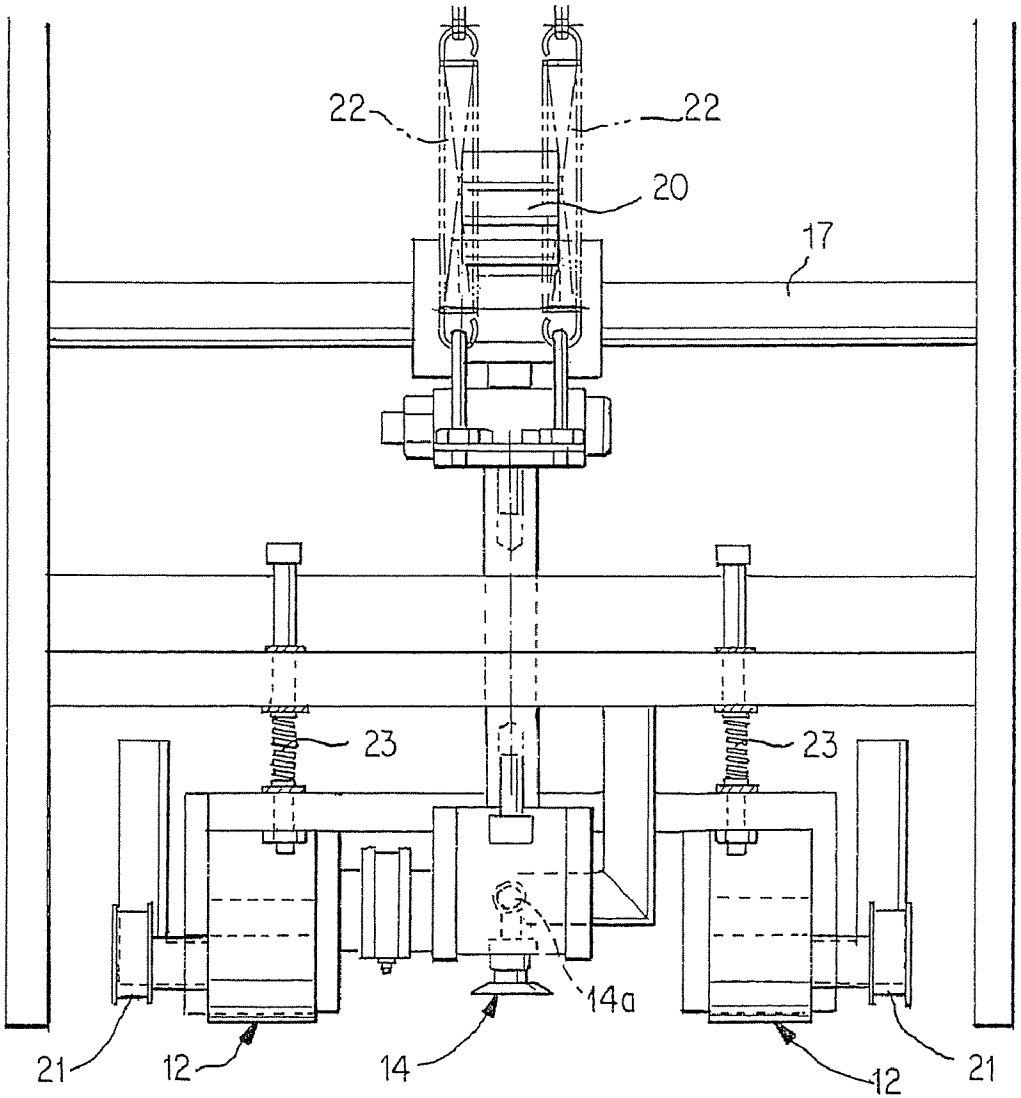
FIG. 4 is a front elevational view of the sheet feeder.

In order for the topmost sheet to become gripped by the suction belts and suction cups, vertical movement of the suction belts 12 and the suction cups 14 is provided by a raising/lowering mechanism 20, 22, 23. The cups 14 are mounted on a common cup carrier 18 to which a downward force is applied periodically by means of a rotary driven cam wheel 20. As the cam wheel is rotated by a horizontal drive shaft 17 (FIG. 4), one segment of the cam wheel's perimeter pushes the cup carrier 18 down against the bias of tensioned return springs 22. Then, another segment of the cam 20 allows the lowered cup carrier to be raised by the return springs 22. The cam wheel is continuously rotated, so that action repeats itself during the feeding of sheets.

Mounted on the cup carrier for movement vertically with respect thereto is a belt carrier 24 which has a pair of sections 24A, 24B that straddle the row of suction cups 14 and carry respective suction belts 12. The belt carrier 24 is biased downwardly by compression springs 23. The cup carrier 18 includes shoulders 18A received in vertical slots 24A of the carrier 24 to form a lost motion connection 26 which enables the cup carrier to move vertically relative to the belt carrier by a limited distance as will be explained.

The suction lines for the suction cups 14 on the one hand, and for the suction belts 12 on the other hand, can be selectively and independently opened and closed relative to a suction source 31 by suitable valves 32, 34 under the control of a controller 36.

Figure 1B:
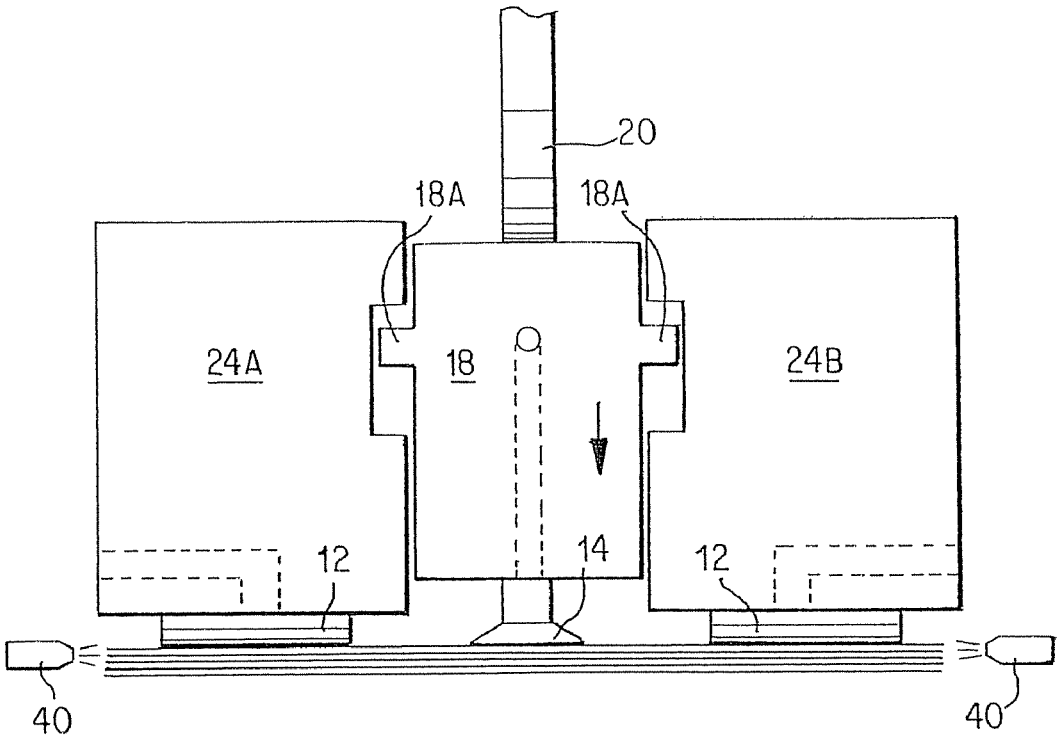

In operation, prior to the feeding of a top sheet of a stack S of sheets (e.g., paper sheets being fed to a paper coater), the feeder head is oriented as shown in FIG. 1A wherein the cup carrier and the belt carrier are fully retracted upwardly, with the springs 23 compressed, and the springs 22 non-stressed (i.e., in a neutral state). Suction to the cups 14 and the belts 12 is blocked, and the belts 12 are stationary. To initiate a feeding operation, the controller 36 activates a stepper motor M to rotate the shaft 17 and the cam 20. The cam initially pushes the cup carrier 18 downwardly, thereby tensioning the return springs 22. The belt carrier 24, seated on the cup carrier via the lost motion connection 26 moves downwardly with the cup carrier under pressure from the compressed springs 23 until the belts 12 abut the top sheet of the stack. The cup carrier continues to move downward, relative to the belt carrier, until the cups 14 also contact the top sheet (FIG. 1B).

Figure 1C:
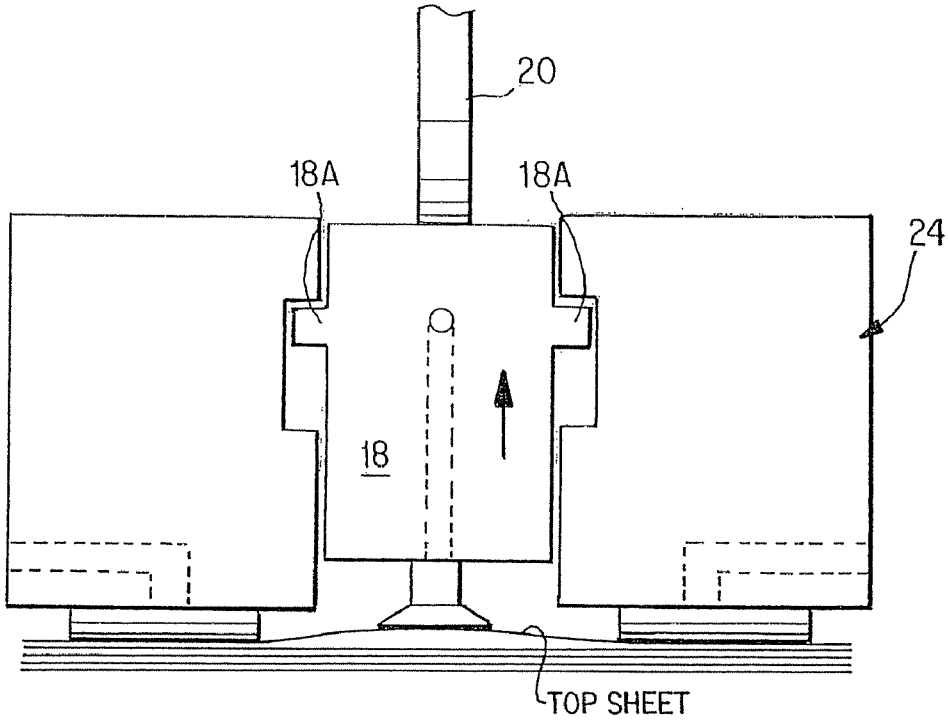

Now, the controller 36 opens valve 32 to communicate the cups 14 with suction, whereupon the cups grip the top sheet. Then, the cup-raising section of the cam begins to engage the cup carrier, enabling the tensioned springs 22 to begin raising the cup carrier, whereupon the cup 14 raises the center portion of the top relative to the sheet's side portions disposed beneath the belts. This causes those side portions to slide slightly relative to the belts, causing the sheet to assume a non-planar shape, e.g., a wavy or corrugated shape (FIG. 1C). In the event that another (bottom) sheet has adhered itself to the underside of this (top) sheet, the corrugating of the top sheet will cause it to be lifted from that bottom sheet, thus tending to break the adherence force between the sheets.

Figure 1D:
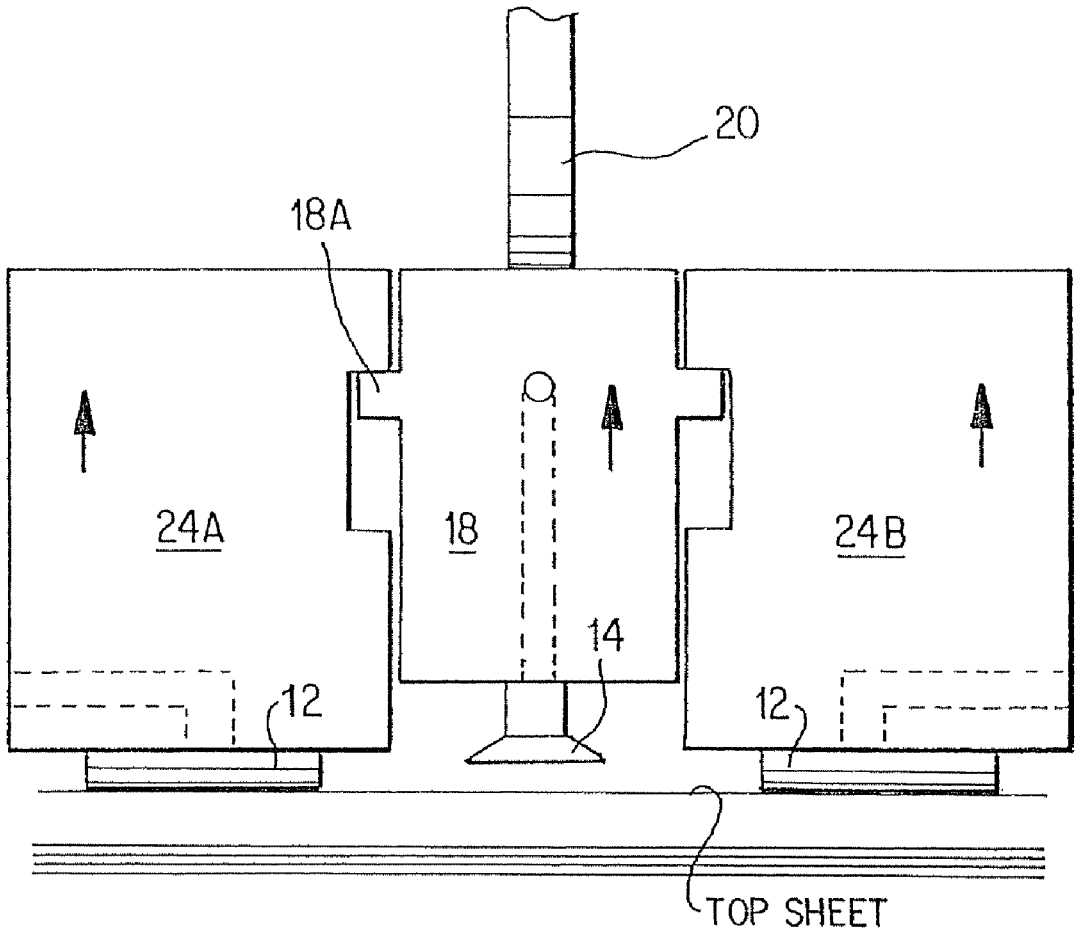

Then, the controller opens the valve 34 to communicate suction to the belts and closes the valve 32 to block suction to the cup. The top sheet is now attached by suction only to the belts 12 (FIG. 1D). Optionally, air nozzles 40 (FIG. 1B) can be provided which direct air against the sides of the stack adjacent the top sheet, in order to induce the top sheet to float off the stack, thereby facilitating the ability of the belt suction to attract and grip the top sheet.

Once the belts have gripped the top sheet, the shoulders 18A of the still-rising cup carrier 18 raise the belt carrier 24. Power is then supplied to the drive rollers 19 of the belts to begin rotating the belts in unison to feed the top sheet in a feed direction F where it can be picked up by driven feed rollers (not shown).

After the sheet has been fed, the rotating cam 20 begins a new feeding operation by lowering the cup carrier, and the previously described sequence is repeated for the next sheet. As the stack is depleted, the table on which it is mounted is periodically raised by a conventional indexing mechanism to keep the top sheet at a prescribed elevation.

Figure 2:
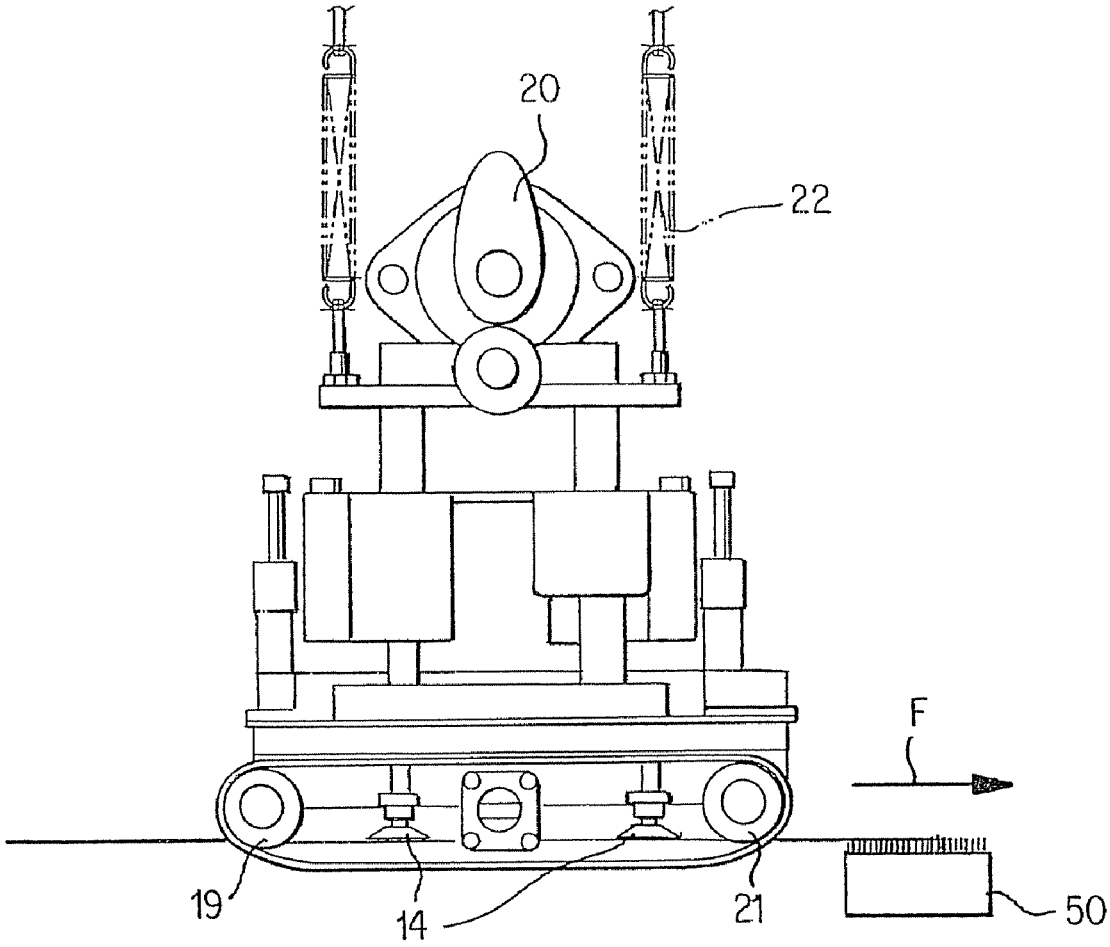
FIG. 2 is a side elevational view of the sheet feeder.
Figure 3:
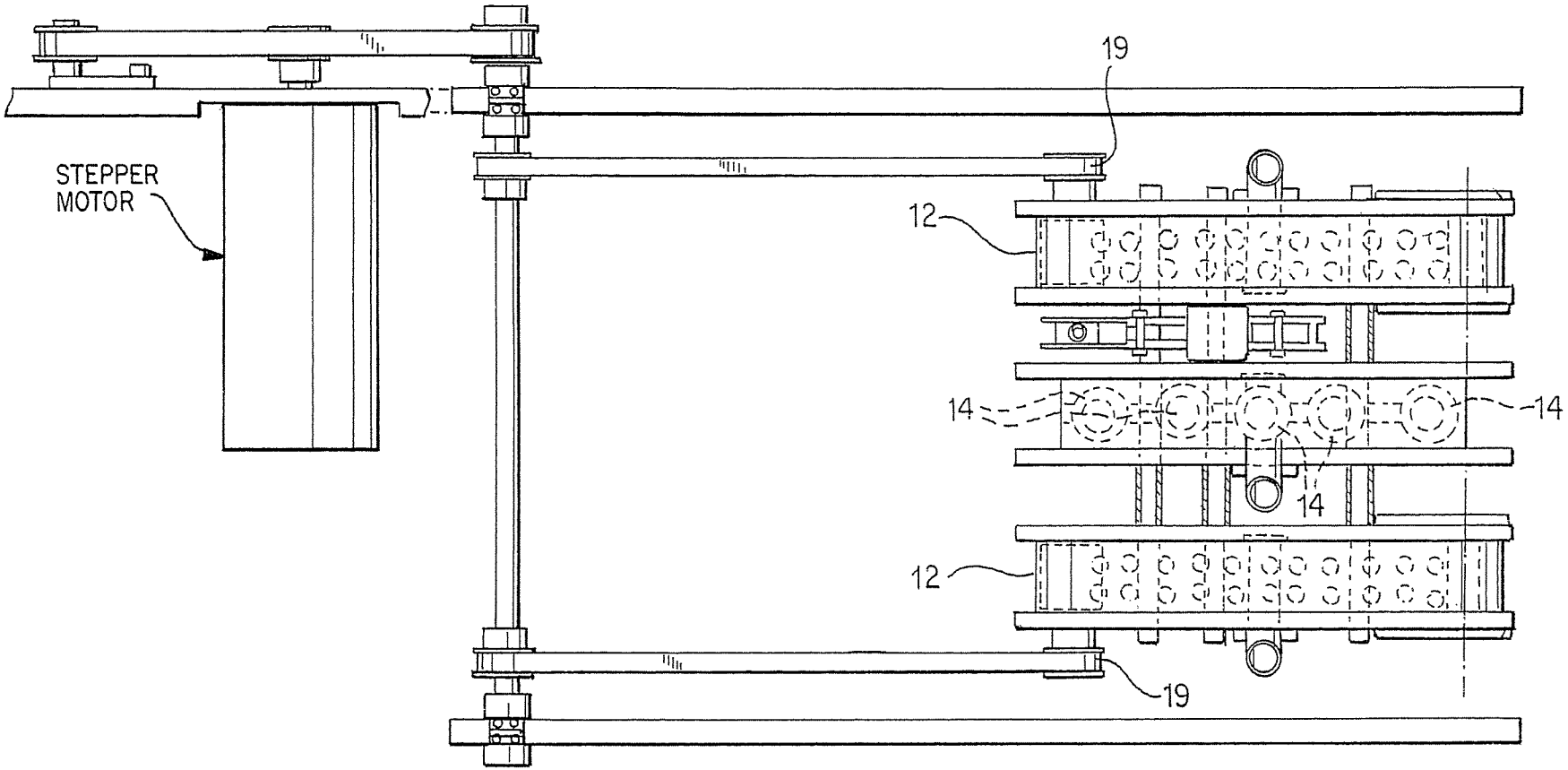
FIG. 3 is a top plan view of the sheet feeder.

Located immediately downstream of the feeder head 10 is a sheet-contact brush 50 (FIG. 2) which has an upper surface that contains bristles. The brush 50 is arranged so that sheets being fed will slide across the bristles. In the event that double sheets are being fed, the friction of the bristles acting on the underside of the unwanted bottom sheet will tend to retard the speed of that bottom sheet, thereby promoting separation of that sheet from the top sheet.

Disposed along the sheet travel path are sensors (not shown) which sense the presence of sheets. The controller 36 knows the timing when each fed sheet should reach each sensor. Thus, when an extra sheet is removed from the bottom of a fed sheet by the brush 50, that extra sheet will constitute a sheet not in the normal sequence (i.e., not recognized by the controller) so such sheet will eventually be sensed by a sensor at a location where no sheet is supposed to be at that time, thus resulting in an alarm signal being emitted, or even a shutdown of all or part of the feed system until the extra sheet has been removed.

Figure 6:
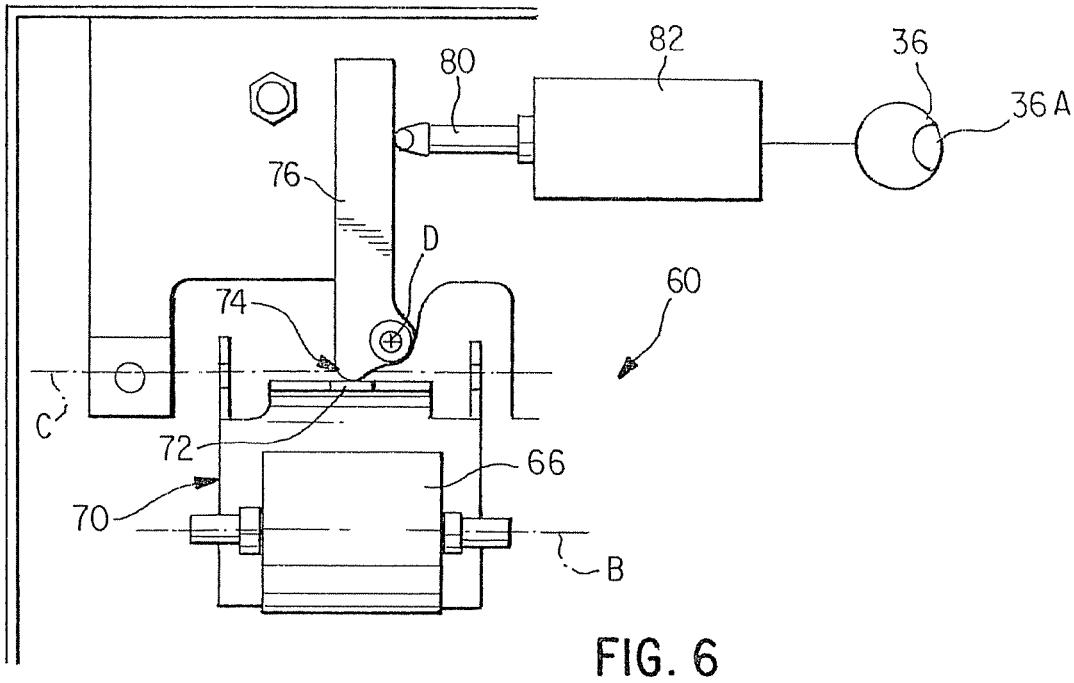
FIG. 6 is a top plan view of the double sheet detector of FIG. 2.
Figure 5:
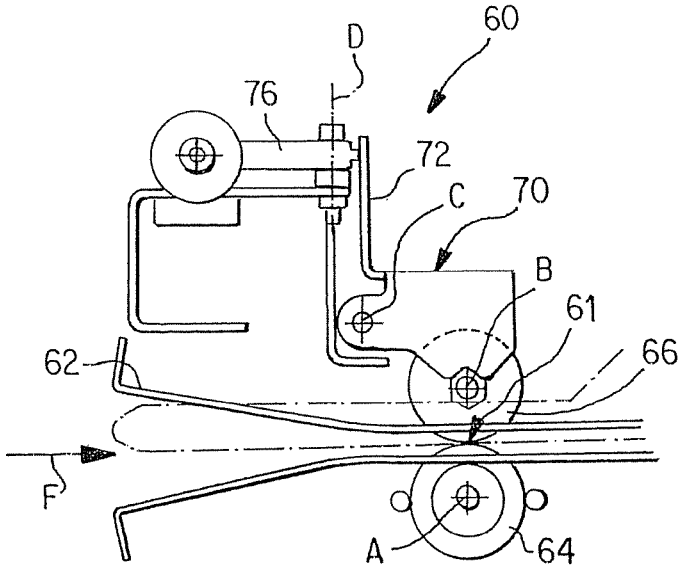
FIG. 5 is a side elevational view of a double sheet detector.

Located in the sheet feed path downstream of the brush 50 is a double sheet detector mechanism 60 (FIGS. 5 and 6). That mechanism includes an inlet guide 62 which guides the sheets traveling in feed direction F into a nip 61 formed between a pair of elastomer-covered nip rollers, namely a lower drive roller 64 and an upper free-wheeling roller 66 which is driven by the drive roller. The drive and freewheeling rollers rotate about respective horizontal axes A, B. The axis A is fixed, and the axis B is freely floating.

The upper roller 66 is mounted on a carrier in the form of a bracket 70 that is freely pivotable about a horizontal axis C, thus enabling the roller 66 to vertically float. The bracket 70 includes an upwardly projecting finger 72, an upper end of which is arranged to engage a contact projection 74 of a lever 76 that is freely rotatable about a vertical axis D.

Arranged to contact the lever 76 at a location remote from the axis D is the horizontal plunger 80 of a conventional electric transducer 82. The plunger 80 is linearly reciprocable, and the transducer 82 is operable to generate an electrical signal commensurate with the extent of the plunger's linear displacement and send that signal to the controller 36. In the event double sheets are fed through the nip, the extra sheet thickness produced by the presence of the additional sheet will generate greater displacement of the transducer's plunger and a greater output signal which can be recognized as a double sheet condition by the controller which compares the output signal to a reference value. The controller can then emit a warning signal, or shut down the entire feed system, or only a part of the feed system, including the detector mechanism 60 and the mechanisms located upstream thereof (to allow sheets that have already passed the detector mechanism to continue being treated, e.g., coated).

It will be appreciated that double sheet sensors using nip rollers and transducer-like equipment have been proposed (e.g., see the aforementioned U.S. Pat. No. 4,420,747). The present invention offers advantages thereover. Firstly, the provision of a lever 76 to transmit displacement of the bracket 70 to the transducer's plunger 80 will amplify the amount of the plunger's displacement, because the distance between the lever's pivot axis D and the point of contact between the lever and the plunger 80 is greater than the distance between the axis D and the point of contact between the lever and the finger 72. Since displacements of the bracket 70 will be slight (due to the minute thickness of the sheets being fed), such amplification will make the plunger movement easier to measure.

The second advantage relates the elimination of a shortcoming mentioned earlier, i.e., that the movement of the bracket 70 can be distorted by inaccuracies in the shape and/or positioning of the nip rollers. That is, in the absence of extremely precise manufacturing techniques, there will likely occur slight eccentricities in the shape of the nip rollers, or the rollers may be slightly out-of-round, or the axis of the rollers might not be perfectly horizontal. Any of these possibilities can cause distortions in the plunger displacement which are unrelated to the sheets. In other words, as the detector operates without sheets passing therethrough, the output of the transducer, which theoretically should be constant, will vary due to the afore-described irregularities. Thus, in the absence of highly expensive precision-made rollers, the signals generated by the transducer may be ineffective from the standpoint of being able to accurately detect the presence of double sheets.

However, in accordance with the present invention, signals from the transducer are detected very frequently, i.e., once each millisecond, and those signals are averaged, whereby the signal discrepancies due to the above-mentioned irregularities will cancel out. Thus, when double sheets are fed, the resulting increase in the averaged transducer signals will accurately reflect the increased sheet thickness and enable the double sheet condition to be recognized.

This will be understood from the following description of a preferred mode of operation. Before the beginning of a sheet feeding operation, the detector mechanism 60 is operated by driving the roller 64 against the roller 66. The resulting signals from the transducer 82 (representing displacements of the roller 66) are sent to a conventional signal averaging circuit 36A in the controller which averages the signals frequently, e.g., every millisecond (which is considerably less than the time for a sheet to pass through the nip). The averaging produces a reference value or "zero-point". Then, single sheets are fed through the nip to produce, for each sheet, multiple transducer signals which are averaged to produce a first average (which will be higher than the zero point). Then, double sheets are fed through the nip to produce, for each sheet, multiple transducer outputs which are averaged to produce a second average. (which will be higher than the zero point and the first average). Therefore, during a normal sheet feeding operation, transducer outputs currently being obtained for each sheet will be averaged to produce a current average value for each sheet. The controller 36 will calculate the difference between such current average value and the zero point and determine therefrom whether single or double sheets are being fed, based on that difference. Thus, the present invention enables a nip/transducer type of double sheet detector to be accurately used with imprecisely manufactured (inexpensive) and imprecisely oriented nip rollers.

Alternative ways of performing this method do not require that the zero point be used as the reference value being compared with the current average displacement. Rather, the reference value could be the average displacement produced while feeding only single sheets or while feeding only double sheets, since a comparison of either of those values with the current average value can be used to indicate whether single sheets or double sheets are currently being fed.

It will be appreciated that the system described above will tend to break any adherence (e.g., static friction) between adjacent paper sheets in a stack, thereby minimizing the chance for the feeding of double sheets. Moreover, even if double sheets are fed from the stack, the passing of the sheets over the bristles will tend to remove the lower sheet. Finally, the detector mechanism provides an economical way of detecting the feeding of double sheets.

In sum, each of those three expedients, whether used singularly or in combination, will reduce the risk of double sheets from being fed to a target region, such as a region of high temperature.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

The invention claimed is:

1. An apparatus for detecting the feeding of double sheets comprising a roller nip formed between a driven roller and a freewheeling roller and through which sheets are fed, the driven roller being rotatable about a fixed horizontal first axis, the freewheeling roller being rotatable about a horizontal second axis and mounted on a vertically floating carrier, the first and second axes being vertically spaced apart, a lever separate from the carrier and rotatable about a vertical third axis and including first and second portions disposed to opposite sides of said third axis, said first portion arranged to be contacted by said carrier for pivoting said lever, said second portion arranged to contact a transducer, a distance from the third axis to the second portion being longer than a distance from the third axis to the first portion.

2. The apparatus according to claim 1, wherein the carrier rotates about a horizontal fourth axis which is offset horizontally from the second axis.

3. A method of detecting the feeding of double sheets, comprising the steps of:

A. providing a roller nip through which sheets are fed, the nip formed by a drive roller and a freewheeling roller driven by the drive roller, the drive roller and the freewheeling roller being rotatable about parallel first and second axis, respectively, the first axis being fixed, and the second axis arranged to float toward and away from the first axis;

B. feeding sheets successively through the nip, causing the freewheeling roller to be displaced away from the drive roller;

C. measuring the amount of displacement of the freewheeling roller from the drive roller multiple times during the passage of each successive sheet to obtain multiple displacement measurements per sheet;

D. averaging the multiple displacement measurements per sheet obtained in step C to produce a current average displacement per sheet; and E. comparing the current average displacement per sheet produced in step F with a reference value to determine whether double sheets are being fed.

4. The method according to claim 3, wherein the measurements per sheet are made approximately each millisecond.

5. The method according to claim 3, wherein the reference value is obtained by producing an average displacement while driving the nip roller with no sheets being fed.

6. The method according to claim 3, wherein the reference value is obtained by producing an average displacement while driving the nip rollers with only single sheets being fed.

7. The method according to claim 3, wherein the reference value is obtained by producing an average displacement while driving the nip rollers with only double sheets being fed.

* * * * *